United States Patent [19]

Berry et al.

[11] Patent Number: 4,667,752

[45] **Date of Patent: * May 26, 1987**

[54] TOP HEAD DRIVE WELL DRILLING APPARATUS WITH STABBING GUIDE

[75] Inventors: Joe R. Berry, Round Rock; William R. Hamilton, Georgetown, both of Tex.

[73] Assignee: Hughes Tool Company, Houston, Tex.

[ * ] Notice: The portion of the term of this patent subsequent to May 20, 2003 has been disclaimed.

[21] Appl. No.: 874,818

[22] Filed: Jun. 12, 1986

Related U.S. Application Data

[63] Continuation of Ser. No. 722,864, Apr. 11, 1985, abandoned.

[51] Int. Cl.[4] ..... E21B 19/16

[52] U.S. Cl. ..... 175/85; 81/57.34; 81/57.35; 173/164; 175/113

[58] Field of Search ..... 175/52, 85, 113, 122, 175/162, 170, 203, 220; 166/77.5, 78, 85; 81/57.16, 57.34, 57.15, 57.20, 57.33, 57.44, 57.35; 414/22; 173/164

[56] References Cited

U.S. PATENT DOCUMENTS

| | | | |
|---|---|---|---|
| Re. 26,284 | 10/1967 | O'Neill et al. | 175/85 |
| 3,280,920 | 10/1966 | Scott | 175/85 |
| 3,312,294 | 4/1967 | Wilson | 175/85 |
| 3,734,210 | 5/1973 | Wilderman | 414/22 |
| 3,915,244 | 10/1975 | Brown | 166/77.5 |
| 4,128,135 | 12/1978 | Mitchhart et al. | 175/85 |
| 4,421,179 | 12/1983 | Boyadjieff | 173/44 |
| 4,440,536 | 4/1984 | Scaggs | 414/22 |
| 4,449,596 | 5/1984 | Boyadjieff | 175/85 |
| 4,489,794 | 12/1984 | Boyadjieff | 175/85 |
| 4,589,503 | 5/1986 | Johnson et al. | 175/113 |

FOREIGN PATENT DOCUMENTS

| | | | |
|---|---|---|---|
| 2047306 | 11/1980 | United Kingdom | 175/85 |

OTHER PUBLICATIONS

"Power Swivel, DDM-650, Derrick Drilling Machine," Maritine Hydraulics.

"Varco Top Drive Drilling System, Description and Specifications," Varco Oil Tools, Feb. 1983.

*Primary Examiner*—James A. Leppink

*Assistant Examiner*—Hoang C. Dang

*Attorney, Agent, or Firm*—H. Dennis Kelly

[57] ABSTRACT

A top head drive well drilling apparatus having a drive unit for rotating a drill string about the longitudinal axis of the drill string. The drive unit is mounted on a carriage, which is guided along a guide track. A stem extends downward from the drive unit to transmit torque from the drive unit to the drill string. A wrench assembly is mounted on the drive unit for making and breaking connections between the stem and the drill string. The wrench assembly can be moved vertically and horizontally in relation to the stem. A stabbing guide is mounted on the wrench assembly for aligning the stem and the drill string. The stabbing guide can be moved vertically relative to the wrench assembly, and has a gripping head having a pair of pivotal latch arms for closing around the drill string. A trigger and a limit switch automatically close the latch arms around the drill string when the stabbing guide is moved onto the drill string.

10 Claims, 6 Drawing Figures

TOP HEAD DRIVE WELL DRILLING APPARATUS WITH STABBING GUIDE

BACKGROUND OF THE INVENTION

This application is a continuation of the application Ser. No. 722,864 filed Apr. 11, 1985, now abandoned.

1. Field of the Invention

This invention relates in general to a well drilling apparatus and in particular to a top head drive well drilling apparatus.

2. Description of the Prior Art

Most oil well drilling rigs have a rotary table and a kelly bushing, which rotate a square or hexagonal kelly, attached to a drill string. A top head drive drilling system, however, eliminates the rotary table, the kelly bushing, and the kelly. An electric drilling motor is suspended from a conventional hook, and may also be attached to a carriage, which is guided by a pair of vertical tracks. The drilling motor is connected to the drill string by a cylindrical quill or stem, which extends downward from the motor. A wrench assembly may also be suspended from the drilling motor, in order to break out or make up connections between the stem and the drill string. Such a system is described in patent application Ser. No. 06/600,939, filed Apr. 16, 1984.

When stabbing the top drive quill into the upper end of the drill string, it is necessary to provide a means for aligning the lowest connection on the quill with the upper connection of the drill string. In the past, this function has been provided by a stabbing guide mounted on a transfer elevator. The stabbing guide, when mounted on the transfer elevator, is somewhat cumbersome and requires that the operations for adding a stand of pipe to the drill string be substantially different from the conventional rig operations.

SUMMARY OF THE INVENTION

The present invention is a top head drive well drilling apparatus, having a wrench assembly and a stabbing guide mounted on the drive unit. The stabbing guide, which is for aligning the the drill string with the stem of the drive unit, has a gripping head, having a pair of pivotal latch arms for closing around the drill string. The stabbing guide may have a trigger, mounted between the latches, to contact the drill string when the stabbing guide is moved onto the drill string, and to automatically close the latches around the drill string. The stabbing guide can be moved vertically relative to the wrench assembly to stab the drill string onto the stem.

The above, as well as additional objects, features, and advantages of the invention, will become apparent in the following detailed description.

DESCRIPTION OF THE PREFERRED EMBODIMENT

Figure 1:
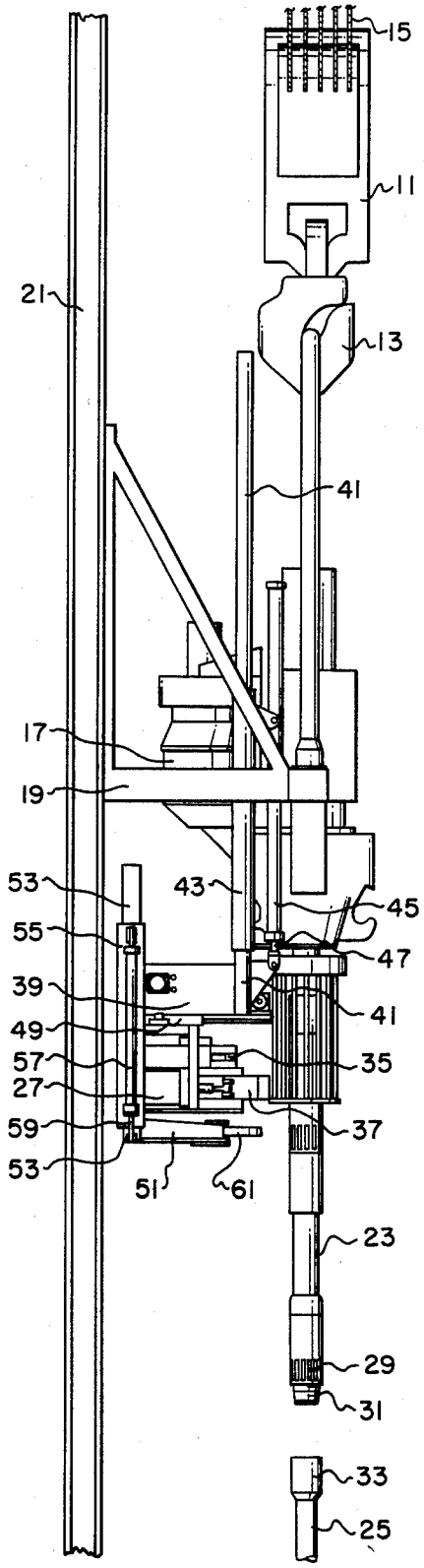
FIG. 1 is a side view of the top head drive well drilling apparatus, with the wrench assembly and the stabbing guide in the upper and retracted position.

FIGS. 1–4 show the sequence of operation for the top head drive well drilling apparatus of the invention. A conventional travelling block 11 and a conventional hook 13 are suspended by cables 15 from the top of an oil well derrick. A drive unit 17 is suspended from the hook 13 and mounted on a carriage 19. The drive unit 17 is preferably a drilling motor of a conventional type. The carriage 19 is a means for connecting the drive unit 17 to a pair of generally vertical guide tracks 21 and guiding the drive unit 17 along the guide tracks 21. The carriage 19 and the guide tracks are a means for preventing the drive unit 17 from rotating about a vertical axis. A cylindrical quill, or stem 23, extends downward from the drive unit 17, and connects to the top of a drill string 25. The drill string 25 consists of a series of pipe sections and has a rotary rock bit at the bottom for drilling a well bore.

Figure 2:
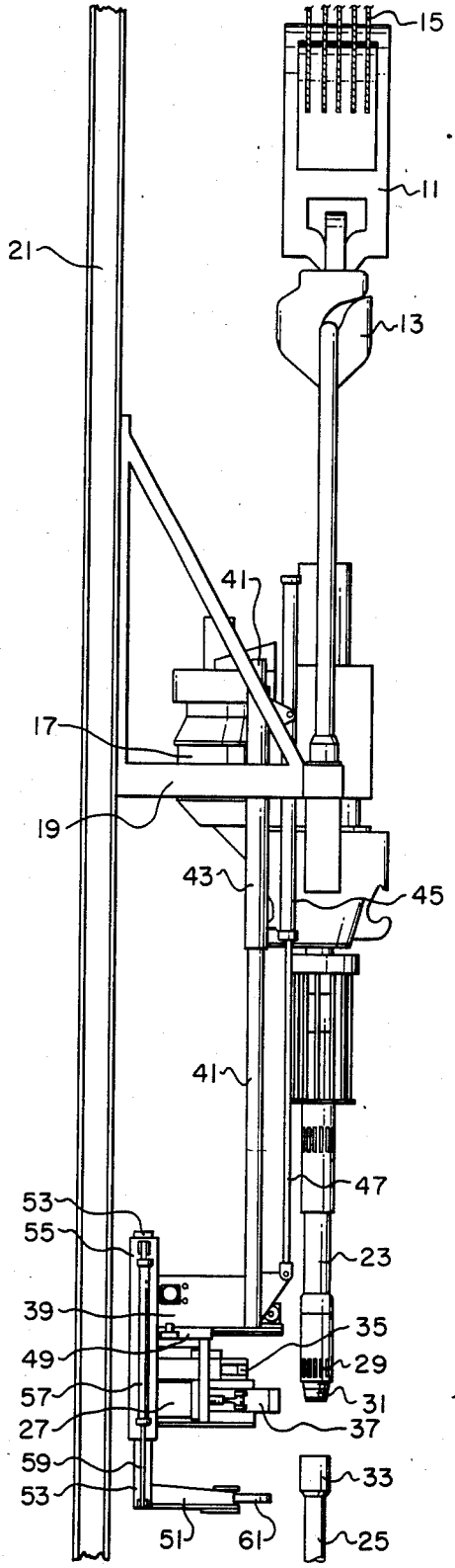
FIG. 2 is a side view of the top head drive well drilling apparatus, with the wrench assembly and the stabbing guide in the lower and retracted position.
Figure 3:
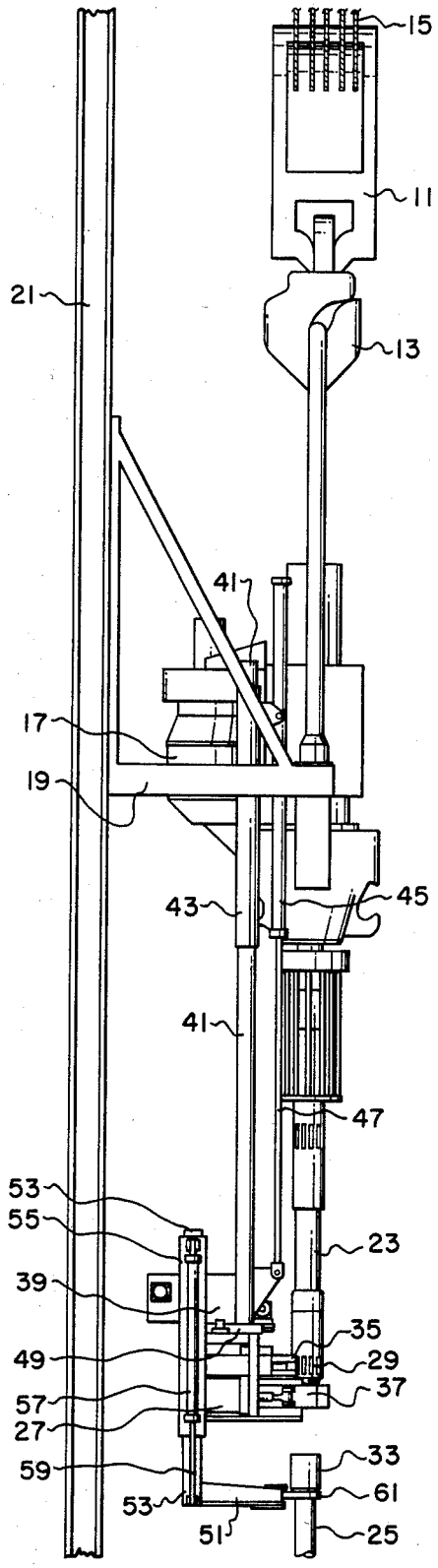
FIG. 3 is a side view of the top head drive well drilling apparatus, with the wrench assembly and the stabbing guide in the lower and working position.
Figure 4:
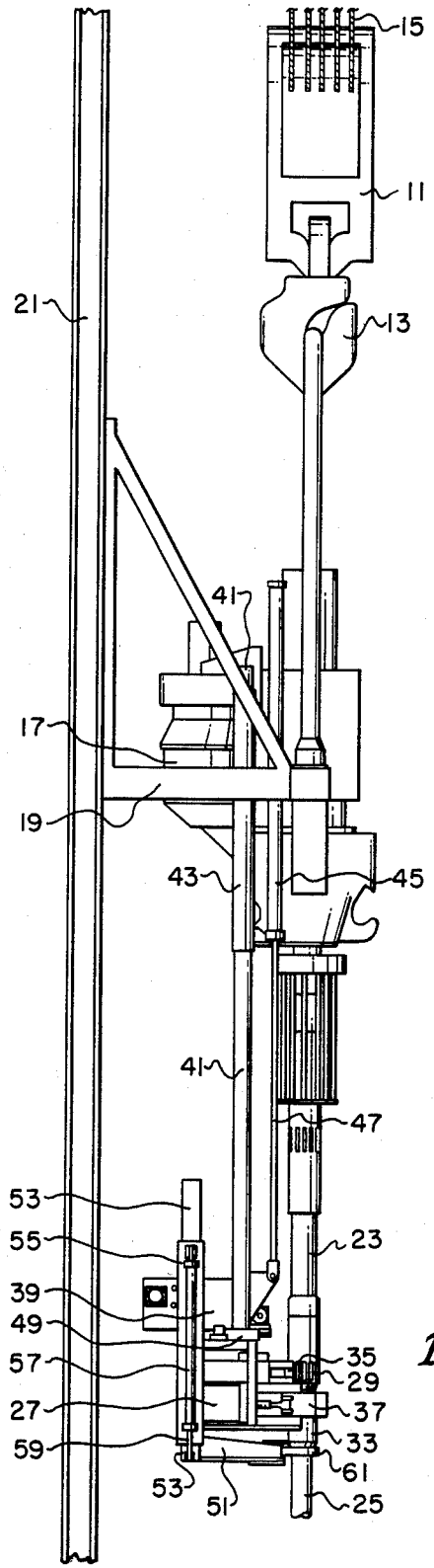
FIG. 4 is a side view of the top head drive well drilling apparatus, with the wrench assembly in the lower and working position, and the stabbing guide in the stabbing position.

FIGS. 1 and 2 show the wrench assembly 27 in the retracted position, and FIGS. 3 and 4 show the wrench assembly 27 in a working position on the stem 23. In the retracted position, the wrench assembly 27 is back away from the stem 23. The working position of the wrench assembly 27 is up near the stem 23, so that the wrench assembly 27 can make and break connections.

The wrench assembly 27 is also capable of moving vertically relative to the stem 23. FIG. 1 shows the wrench assembly 27 in its uppermost position, and FIGS. 2–4 show the wrench assembly 27 near its lowermost position. When the wrench assembly 27 is in the uppermost position, the stem can drill further before stopping to add a new section of pipe to the string 25. The lowermost position of the wrench assembly 27 is slightly below the bottom of the stem 23.

The stem, or quill 23, consists of various combinations of kelly cocks and subs. At the lower end, the stem 23 has a set of splines 29 and a pin connection 31 The pin 31 is adapted to connect into a box connection 33 on the upper end of the drill string 25.

The wrench assembly 27 has an upper wrench 35 and a lower wrench 37. The upper wrench 35 is a spline wrench, and engages the splines 29 on the stem 23. The lower wrench 37 has grippers and grips the box 33 on the upper end of the drill string 25. The wrenches 35, 37 can thus make up or break out connections between the stem 23 and the drill string 25 in a manner well known in the art. The wrench assembly 27 can also make up or break out connections between the various subs in the stem 23, such as the kelly cocks.

The wrench assembly is mounted on a wrench assembly bracket 39. This bracket 39 has a guide member 41, which extends upward through a guide sleeve 43 on the drive unit 17. Therefore, the wrench assembly 27 is indirectly connected to the drive unit 17. A hydraulic cylinder 45 is also mounted on the drive unit 17, and the piston rod 47 is connected to the wrench assembly bracket 39. The hydraulic cylinder 45 is the means for moving the wrench assembly 27 vertically relative to the stem 23.

A second hydraulic cylinder 49 is mounted on the wrench assembly bracket 39. This hydraulic cylinder 49 is a means for moving the wrench assembly 27 between the retracted position and the working position. The retracted position, shown in FIGS. 1 and 2, is away from the longitudinal axis of the stem 23 and the drill string 25. The working position, shown in FIGS. 3 and 4, is along the axis of the drill string 25.

A stabbing guide 51 is mounted below the wrench assembly 27, at the bottom of a guide member 53. The guide member 53 extends upward through a guide sleeve 55, which is attached to the wrench assembly bracket 39. A hydraulic cylinder 57 is attached to the side of the guide sleeve 55, and the piston rod 59 is attached to the guide member 53. The hydraulic cylinder 57 is a means for moving the stabbing guide 51 between an upper position, directly below the wrench assembly 27, as shown in FIGS. 1 and 4, and a lower position, as shown in FIGS. 2 and 3. The stabbing guide 51 has a gripping head 61 for gripping the drill string 25.

Figure 5:
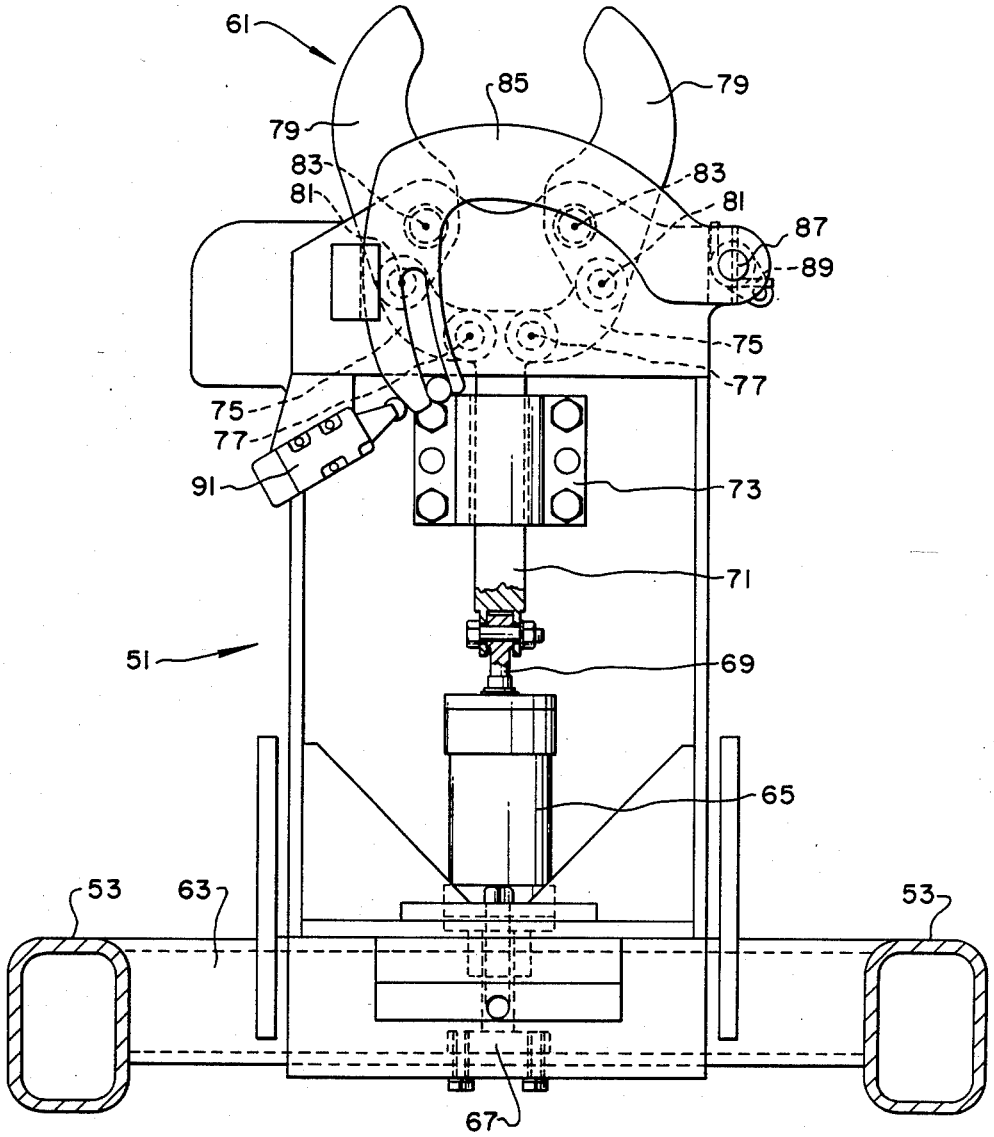
FIG. 5 is a top view of the stabbing guide in the open position.
Figure 6:
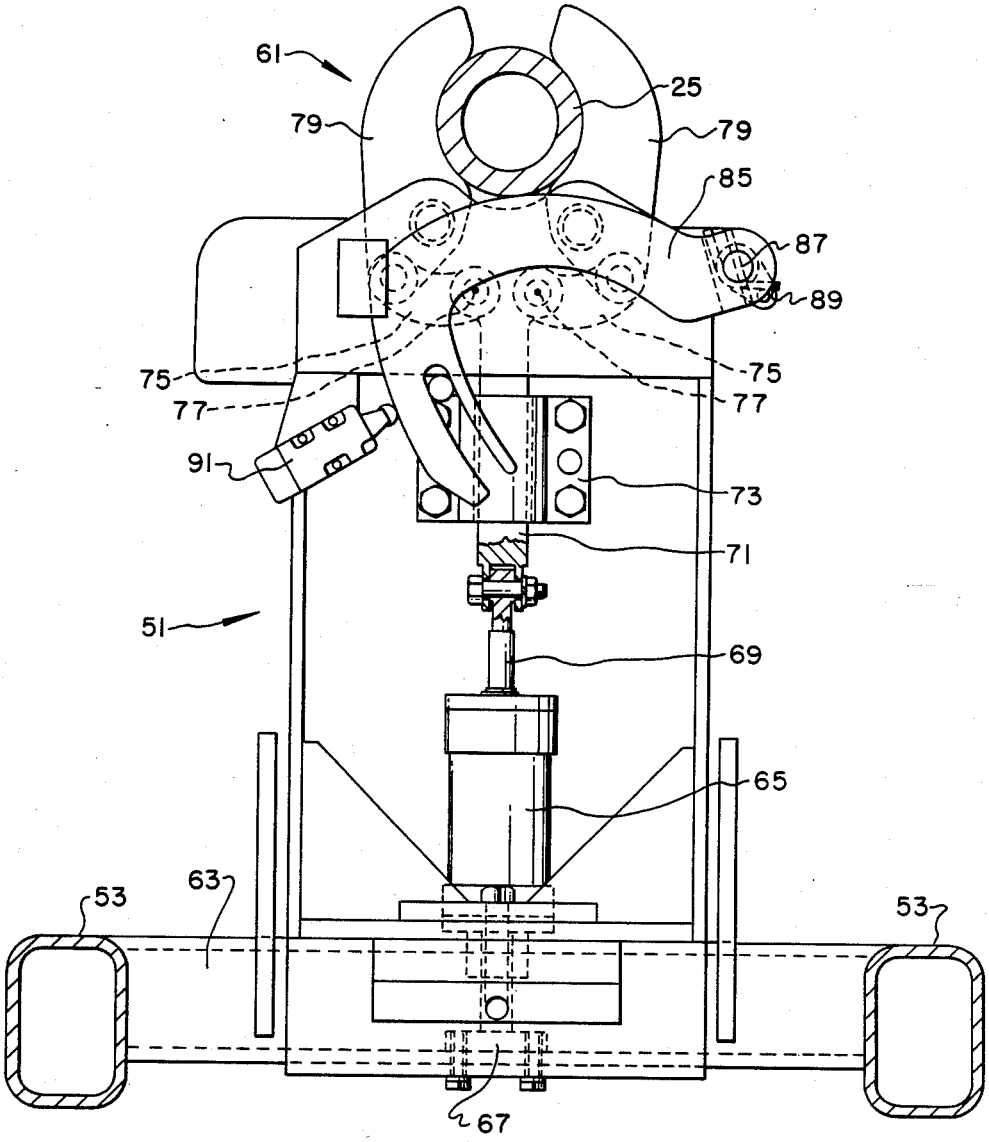
FIG. 6 is a top view of the stabbing guide, closed around the drill string.

FIGS. 5 and 6 show the stabbing guide 51 in greater detail. A stabbing guide frame 63 is connected to the lower end of the guide members 53. A hydraulic cylinder 65 is attached to a cylinder mount 67, which is bolted onto the stabbing guide frame 63. A piston rod 69 extends out of the hydraulic cylinder 65, toward the gripping head 61, and a cylinder extension rod 71 is bolted onto the end of the piston rod 69. The cylinder extension rod 71 extends through a cylinder guide 73 to the gripping head 61.

A pair of links 75 are pivotally attached to the end of the cylinder extension rod 71 at pivot points 77. Each link 75 is also connected pivotally to a latch arm 79 at a pivot point 81. Each latch arm 79 is connected to the stabbing guide frame 63 at a pivot point 83. The cylinder extension rod 71, the lines 75, and the latch arms 79 work together, so that when the hydraulic cylinder 65 retracts the piston rod 69, the latch arms 79 move to their open position, as shown in FIG. 5. When the hydraulic cylinder 65 extends the piston rod 69, the latch arms 79 move to their closed position, as shown in FIG. 6. The hydraulic cylinder 75 is remotely operable, so the latch arms 79 can be opened and closed at will.

The hydraulic cylinder 65 is also activated automatically, whenever the stabbing guide 51 is moved onto the drill string 25. A trigger 85 is pivotally connected to the stabbing guide frame 63 at pivot point 87. A spring 89 biases the trigger 85 in the open position shown in FIG. 5. When the stabbing guide 51 is placed onto the drill string 25, the drill string 25 pushes the trigger 85 to its closed position, shown in FIG. 6. The trigger 85, in its closed position, presses on a limit switch 91, which actuates the hydraulic cylinder 65 to extend the piston rod 69 and to close the latch arms 79. The trigger 85 and the limit switch 91 are thus the actuating means for automatically closing the latch arms 79 around the drill string 25 when the stabbing guide 51 is moved onto the drill string 25.

The operation of the invention will be explained beginning with the apparatus in the position shown in FIG. 1. The wrench assembly 27 and the stabbing guide 51 are in their retracted and uppermost positions. The hydraulic cylinder 45 moves the wrench assembly 27 downward to its lowermost position, slightly below the position shown in FIG. 2. In its lowermost position, the wrench assembly is slightly below the splines 29 and the pin connection 31 on the quill or stem 23. Hydraulic cylinder 57 lowers the stabbing guide 51 to its lowermost position, which is an additional distance below the lowermost position of the wrench assembly 27. The stabbing guide 51 is now below the box connection 33 on the drill string 25, and the apparatus is slightly below the position shown in FIG. 2.

Hydraulic cylinder 49 then moves the wrench assembly 27 and the stabbing guide 51 to the working position, along the axis of the drill string 25, and the hydraulic cylinder 45 raises the wrench assembly 27 slightly, to the position shown in FIG. 3. The upper wrench 35 is now engaging the splines 29, and the lower wrench 37 is positioned to receive the box connection 33. The stabbing guide 51 is now on the drill string 25, below the box connection 33.

As the stabbing guide 51 is moved onto the drill string 25, the drill string 25 strikes the trigger 85. This causes the trigger 85 to press the limit switch 91, actuating the hydraulic cylinder 65 to close the latch arms 79 around the drill string 25. The apparatus is now ready to stab the stem 23 into the drill string 25. The hydraulic cylinder 57 raises the stabbing guide 51 and the drill string 25 in relation to the wrench assembly 27. As the stabbing guide 51 is raised, the box 33 is stabbed onto the pin connection 31, as shown in FIG. 4. The wrench assembly 27 then makes up the joint between the stem 23 and the drill string 25.

The stabbing guide of the invention provides several advantages over the prior art. The stabbing guide of the invention is considerably easier to use, and the operations for adding pipe sections or stands to the drill string are more similar to other conventional rig operations. Mounting the stabbing guide 51 on the wrench assembly 27 utilizes the vertical travel of the wrench assembly 27, and thus decreases the required vertical travel of the stabbing guide 51 relative to the wrench assembly 27. The stabbing guide 51 may also have a breakaway means to minimize damage if the guide is overloaded. The hydraulic cylinders used in the apparatus could, if preferred, be powered penumatically.

While the invention has been shown in only one of its forms, it should be apparent to those skilled in the art that it is not so limited, but is susceptible to various changes and modifications without departing from the spirit thereof.

We claim:

1. A top head drive well drilling apparatus, comprising:

a drive unit for rotating a drill string about the longitudinal axis of the drill string;

a stem, extending downward from the drive unit, for transmitting torque from the drive unit to the drill string;

a wrench assembly, mounted on the drive unit, for making and breaking connections between the stem and the drilling string;

means for moving the wrench assembly between a working position on the stem and a retracted position radically away from the stem; and a stabbing guide, mounted on the wrench assembly, for aligning the stem and the drill string.

2. A top head drive well drilling apparatus, comprising:

a drive unit for rotating a drill string about the longitudinal axis of the drill string;

means for preventing the drive unit from rotating about a vertical axis;

a stem extending downward from the drive unit, for transmitting torque from the drive unit to the drill string;

a wrench assembly, mounted on the drive unit, for making and breaking connections between the stem and the drilling string;

means for moving the wrench assembly between a working position on the stem and a retracted position radially away from the stem; and a stabbing guide, mounted on the wrench assembly, for aligning the stem and the drill string.

3. A top head drive well drilling apparatus, comprising:

a drive unit for rotating a drill string about the longitudinal axis of the drill string;

a guide track, which extends generally in a vertical direction;

means for connecting and guiding the drive unit along the guide track;

a stem extending downward from the drive unit, for transmitting torque from the drive unit to the drill string;

a wrench assembly mounted on the drive unit, for making and breaking connections between the stem and the drilling string;

means for moving the wrench assembly between a working position on the stem and a retracted position radially away from the stem; and a stabbing guide, mounted on the wrench assembly, for aligning the stem and the drill string.

4. A top head drive well drilling apparatus, comprising:

a drive unit for rotating a drill string about the longitudinal axis of the drill string;

a guide track which extends generally in a vertical direction;

a carriage for connecting and guiding the drive unit along the guide track;

a stem, extending downward from the drive unit, for transmitting torque from the drive unit to the drill string;

a wrench assembly, mounted on the drive unit, for making and breaking connections between the stem and the drilling string;

means for moving the wrench assembly between a working position on the stem and a retracted position radially away from the stem; and a stabbing guide, mounted on the wrench assembly, for aligning the stem and the drill string.

5. A top head drive well drilling apparatus, comprising:

a drive unit for rotating a drill string about the longitudinal axis of the drill string;

a guide track, which extends generally in a vertical direction;

a carriage for connecting and guiding the drive unit along the guide track;

a stem, extending downward from the drive unit, for transmitting torque from the drive unit to the drill string;

a wrench assembly, mounted on the drive unit, for making and breaking connections between the stem and the drilling string;

means for moving the wrench assembly between a working position on the stem and a retracted position away from the stem;

a stabbing guide, mounted on the wrench assembly, for aligning the stem and the drill string; and means for moving the stabbing guide vertically relative to the wrench assembly.

6. A top head drive well drilling apparatus, comprising:

a drive unit for rotating a drill string about the longitudinal axis of the drill string;

a guide track, which extends generally in a vertical direction;

a carriage for connecting and guiding the drive unit along the guide track;

a stem, extending downward from the drive unit, for transmitting torque from the drive unit to the drill string;

a wrench assembly, mounted on the drive unit, for making and breaking connections between the stem and the drilling string;

means for moving the wrench assembly between a working position on the stem and a retracted position away from the;

a stabbing guide, mounted on the wrench assembly, for aligning the stem and the drill string;

means for moving the stabbing guide vertically relative to the wrench assembly; and actuating means for automatically closing the stabbing guide around the drill string when the stabbing guide is moved onto the drill string.

7. A top head drive well drilling apparatus, comprising:

a drive unit for rotating a drill string about the longitudinal axis of the drill string;

a guide track, which extends generally in a vertical direction;

a carriage for connecting and guiding the drive unit along the guide track;

a stem, extending downward from the drive unit, for transmitting torque from the drive unit to the drill string;

a wrench assembly, mounted on the drive unit, for making and breaking connections between the stem and the drilling string;

means for moving the wrench assembly between a working position on the stem and a retracted position away from the stem;

a stabbing guide, mounted on the wrench assembly, for aligning the stem and the drill string, wherein the stabbing guide has a gripping head having a pivotable latch arm for closing around the drill string; and actuating means for automatically closing the latch arm around the drill string when the stabbing guide is moved onto the drill string.

8. A top head drive well drilling apparatus, comprising:

a drive unit for rotating a drill string about the longitudinal axis of the drill string;

a guide track, which extends generally in a vertical direction;

a carriage for connecting and guiding the drive unit along the guide track;

a stem, extending downward from the drive unit, for transmitting torque from the drive unit to the drill string;

a wrench assembly, mounted on the drive unit, for making a breaking connections between the stem and the drilling string;

means for moving the wrench assembly between a working position on the stem and a retracted position away from the stem;

a stabbing guide, mounted on the wrench assembly, for aligning the stem and the drill string, wherein the stabbing guide has a gripping head having a pivotable latch arm for closing around the drill string;

means for moving the stabbing guide vertically relative to the wrench assembly; and actuating means for automatically closing the latch arm around the drill string when the stabbing guide is moved onto the drill string.

9. A top head well drilling apparatus, comprising:

a top drive unit for rotating a drill string about the longitudinal axis of the drill string;

a guide track, which extends generally in a vertical direction;

a carriage for connecting and guiding the drive unit along the guide track;

a stem, extending downward from the drive unit, for transmitting torque from the drive unit to the drill string;

a wrench assembly, mounted on the drive unit, for making and breaking connections between the stem and the drilling string;

means for moving the wrench assembly between a working position on the stem and a retracted position away from the;

a stabbing guide, mounted on the wrench assembly, for aligning the stem and the drill string, wherein the stabbing guide has a gripping head having a pivotable latch arm for closing around the drill string;

means for moving the stabbing guide vertically relative to the wrench assembly; and actuating means for automatically closing the latch arm around the drill string when the stabbing guide is moved onto the drill string, wherein the actuating means includes a trigger, which contacts the drill string when the stabbing guide is moved onto the drill string.

10. A top head drive well drilling apparatus, comprising:

a drive unit for rotating a drill string about the longitudinal axis of the drill string;

a guide track, which extends generally in a vertical direction;

a carriage for connecting and guiding the drive unit along the guide track;

a stem, extending downward from the drive unit, for transmitting torque from the drive unit to the drill string;

a wrench assembly, mounted on the drive unit, for making and breaking connections between the stem and the drilling string;

means for moving the wrench assembly vertically in relation to the stem;

means for moving the wrench assembly between a working position on the stem and a retracted position away from the stem;

a stabbing guide, mounted on the wrench assembly, for aligning the stem and the drill string, wherein the stabbing guide has a gripping head having a pair of pivotable latch arms for closing around the drill string;

means for moving the stabbing guide vertically relative to the wrench assembly; and actuating means for automatically closing the latch arm around the drill string when the stabbing guide is moved onto the drill string, wherein the actuating means includes a trigger, mounted between the latch arms, to contact the drill string when the stabbing guide is moved onto the drill string.

* * * * *